US008342329B2

(12) United States Patent
Kobilarcik et al.

(10) Patent No.: US 8,342,329 B2
(45) Date of Patent: Jan. 1, 2013

(54) STACKABLE STORAGE BIN

(75) Inventors: Albert T. Kobilarcik, Wooster, OH (US); Travis Shamp, Akron, OH (US); Jerrold Brown, Medina, OH (US); Daniel R. Blake, Jr., Chicago, IL (US)

(73) Assignee: Akro-Mils, Inc., Akron, OH (US)

( * ) Notice: Subject to any disclaimer, the term of this patent is extended or adjusted under 35 U.S.C. 154(b) by 231 days.

(21) Appl. No.: 12/893,258

(22) Filed: Sep. 29, 2010

(65) Prior Publication Data

US 2012/0074024 A1 Mar. 29, 2012

(51) Int. Cl.
*B65D 21/032* (2006.01)

(52) U.S. Cl. ..... 206/509; 206/507

(58) Field of Classification Search ..... 206/509, 206/511, 507

See application file for complete search history.

(56) References Cited

U.S. PATENT DOCUMENTS

| | | | | |
|---|---|---|---|---|
| 1,862,609 | A | 6/1932 | Shaw | |
| 3,113,680 | A * | 12/1963 | Frater et al. | 211/126.4 |
| 3,201,035 | A | 8/1965 | Etal | |
| 3,361,293 | A | 1/1968 | Box | |
| 3,842,982 | A | 10/1974 | Joyce | |
| 4,372,444 | A | 2/1983 | Le Grand et al. | |
| 5,190,156 | A | 3/1993 | Conaway et al. | |
| 5,454,234 | A * | 10/1995 | Karmeli | 63/28 |
| 6,273,259 | B1 * | 8/2001 | Stahl | 206/511 |
| 6,394,274 | B1 * | 5/2002 | Cheeseman | 206/511 |
| 2009/0152158 | A1 * | 6/2009 | Kidd et al. | 206/564 |
| 2009/0178989 | A1 * | 7/2009 | Accuardi | 211/126.7 |

OTHER PUBLICATIONS

GLOBAL, http://www.globalindustrial.com/p/storage/bins-totes-containers/stacking-bins/plastic-clear-stacking-bin-5-1-2-w-x-10-7-8-d-x-5-h, Aug. 16, 2010.

* cited by examiner

*Primary Examiner* — Stephen Castellano
(74) *Attorney, Agent, or Firm* — Mattingly & Malur, P.C.

(57) ABSTRACT

A stackable storage bin includes a body having a rim extending around an open top. A first angled slot is formed in an upper edge of each side wall adjacent a rear end thereof and a vertical second slot is formed in the upper edge of each side wall at a position forwardly from the first slot. An angled first tab is formed adjacent the bottom edge of each side wall in a position vertically aligned with the first slot and a vertical second tab is formed adjacent a bottom edge of each side wall at a position vertically aligned with the vertical second slot whereby when two of the bins are in the vertically stacked array, the tabs on the bottom of an upper bin engage the slots on the lower bin to interlock the two bins together.

3 Claims, 11 Drawing Sheets

STACKABLE STORAGE BIN

BACKGROUND OF THE INVENTION

1. Field of the Invention

The present invention relates to an improved stackable storage bin and, more particularly, to a stackable storage bin which is at least partially transparent and at least partially translucent and has a pivotable and removable lid and wherein two bins may be interlocked with each other when in a vertically stacked array.

2. Description of the Related Art

Numerous types of storage bins of the type which are stackable are known in the art. Many of these stackable storage bins are used for storage and/or display of a variety of articles and goods.

There is still a need, however, for a stackable storage bin which is securely interlocked with a lower bin when it is stacked thereon and which is at least partially transparent so that the contents of the bin may be observed from the outside even when the bin has a lid or cover thereon.

SUMMARY OF THE INVENTION

It is an object of the present invention to provide a stackable storage bin which may be securely interlocked with another storage bin when two of the storage bins are stacked in a vertical array.

It is another object of the present invention to provide a stackable storage bin which is at least partially transparent so that the contents of the bin may be observed from the outside.

It is still another object of the present invention to provide a stackable storage bin having a pivotable and removable lid thereon which is at least partially transparent.

It is another object of the present invention to provide a stackable bin which may include divider walls to divide the bin into a plurality of separate compartments.

It is still another object of the present invention to provide a stackable bin which may be hung by the rear wall from a support structure.

The present invention achieves the above and other objects by providing a stackable storage bin for storing and displaying articles therein which includes a bottom wall, two spaced opposed side walls, a rear end wall and a front end wall integrally connected to form a body having an open top. A rim is formed which extends around the open top. A first slot is angled forwardly and formed in an upper edge of each side wall adjacent a rear end thereof and opening into the rim and a second vertical slot is formed in the upper edge of each side wall in a position spaced forwardly from the first slot and also opening into the rim. A first angled tab is provided which extends forwardly at approximately the same angle as the first slot and is formed adjacent a bottom edge of each wall at a position vertically aligned with the first slot. A vertical second tab is provided adjacent a bottom edge of each side wall at a position vertically aligned with the vertical second slot whereby when two of the bins are in a vertically stacked array, the first tabs and the vertical second tabs of an upper bin engage the angled first slots and vertical second slots of a lower bin to interlock the two bins together.

The rim of the storage bin is recessed on an inner edge of each side wall to form a ledge on each side wall extending forwardly from the angled first slot to a position at least beyond the vertical second slot and a horizontal rib is provided on the outside adjacent the bottom of each side wall whereby when two of the bins are in a vertically stacked array, the horizontal ribs of the upper bin engage the ledges of the rim of the lower bin. A downwardly extending back lip is provided adjacent an upper end of the rear wall for engaging a support structure to hang the bin therefrom and a downwardly extending front lip is provided adjacent an upper end of the front wall whereby the bin may be gripped by engaging the front lip.

Upper portions of the side and rear end walls preferably are transparent and lower portions of the side and rear end walls preferably are translucent. The front end wall also is preferably transparent. The side walls are provided with at least one pair of opposed notches on the inside to accommodate a widthwise divider wall and the front and rear end walls are provided with at least one pair of opposed notches on the inside to accommodate a lengthwise divider wall.

The storage bin further may include a removable lid having a pivot pin projecting outwardly on each side adjacent a rear end thereof for accommodation in the angled slot of the rear end of each side wall when the lid is mounted on the bin. At least a center portion of the lid may be transparent.

The bin may be constructed of a suitable plastic material such as polypropylene or polyethylene. When the bin is used in connection with medical applications, it may be constructed of a suitable plastic material containing an antibacterial or other germ killing substance.

These, together with other objects and advantages which may be subsequently apparent, reside in the details of construction and operation as more fully described and claimed hereafter, reference being made to the accompanying drawings forming a part hereof, where like numerals refer to like parts throughout.

DETAILED DESCRIPTION OF THE PREFERRED EMBODIMENTS

Figure 1:
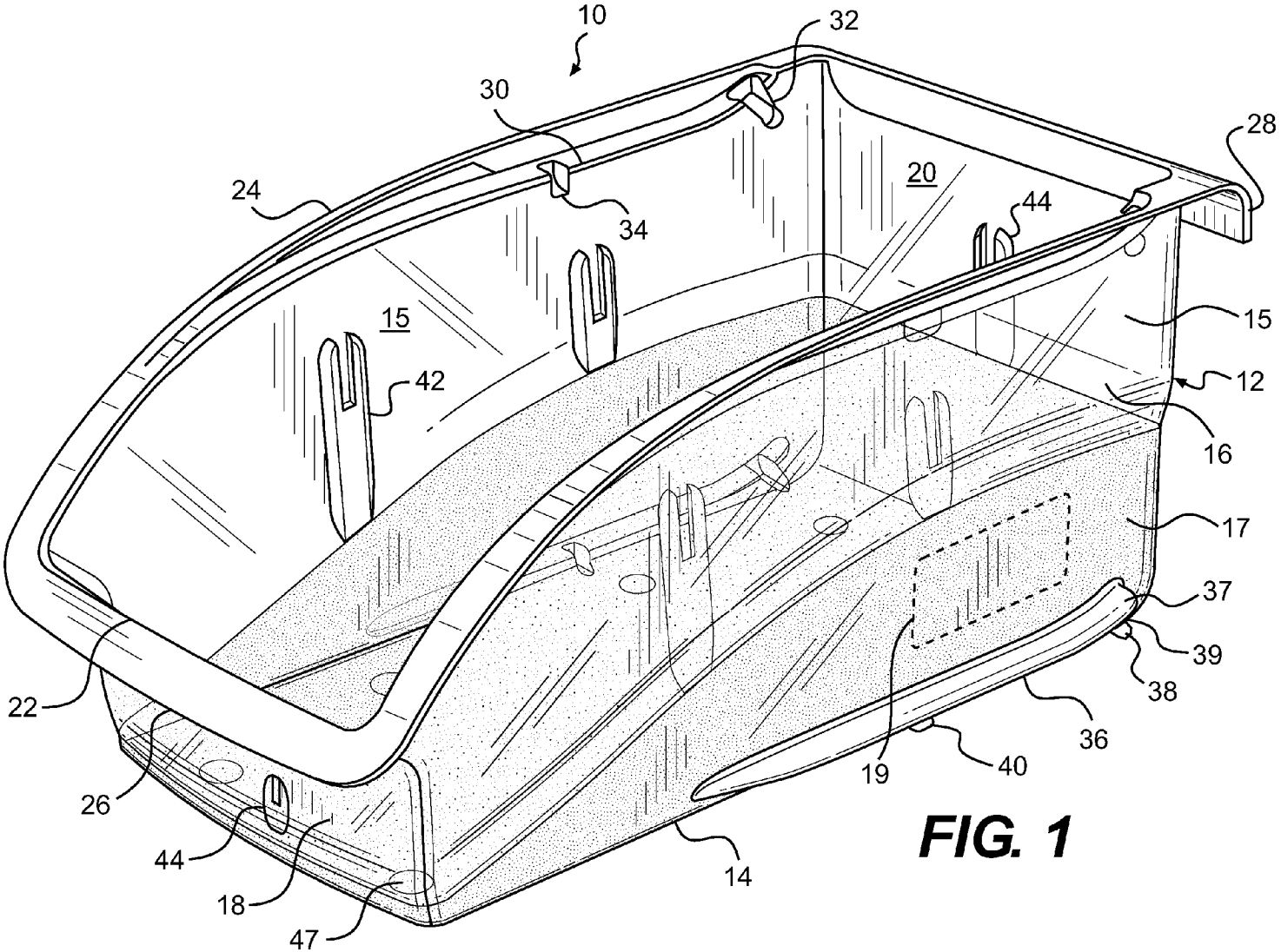
FIG. 1 is a right side perspective view of a transparent storage bin according to the present invention with a top portion of the walls of the bin being transparent and a bottom portion of the walls of the bin being translucent.
Figure 2:
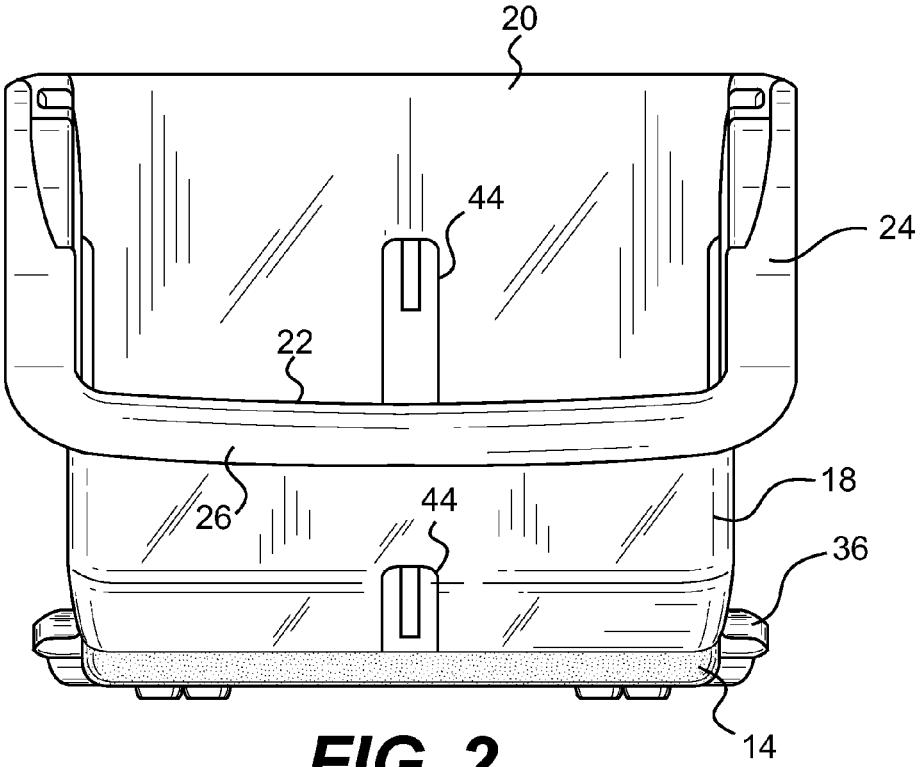
FIG. 2 is a front elevational view of the storage bin of FIG. 1.
Figure 3:
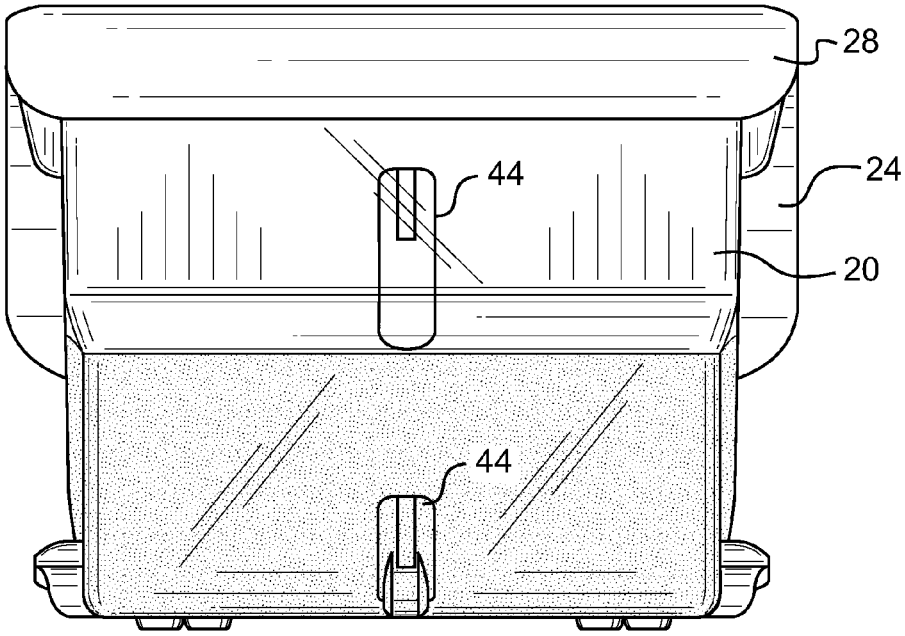
FIG. 3 is a rear elevational view of the storage bin of FIG. 1.

Referring to the drawings, a stackable storage bin, generally referred to by the numeral 10, for holding an article or other product is shown which includes a body 12 having a bottom wall 14, two spaced opposed side walls 15 extending upwardly therefrom, a front end wall 18 extending upwardly from the bottom wall and connected to one end of the side walls and a rear end wall 20 extending upwardly from the bottom wall and connected to an opposite end of the side walls to form an integral body structure.

The storage bin 10 may be constructed of a suitable common plastic material such as polypropylene, polyethylene, polystyrene, high-impact polystyrene and styrene-acrylonitrile. In addition, more specialized plastic materials may be used such as acrylonitrile-butadiene-styrene, cellulose acetate butyrate, cellulose acetate propionate, polycarbonate, polyethylene terephthalate, polymethyl methacrylate (acrylic resin) and polyvinyl chloride. When used in connection with medical supplies or applications, the bin may be constructed of a suitable plastic material containing an anti-bacterial or other germ killing substance.

Figure 4:
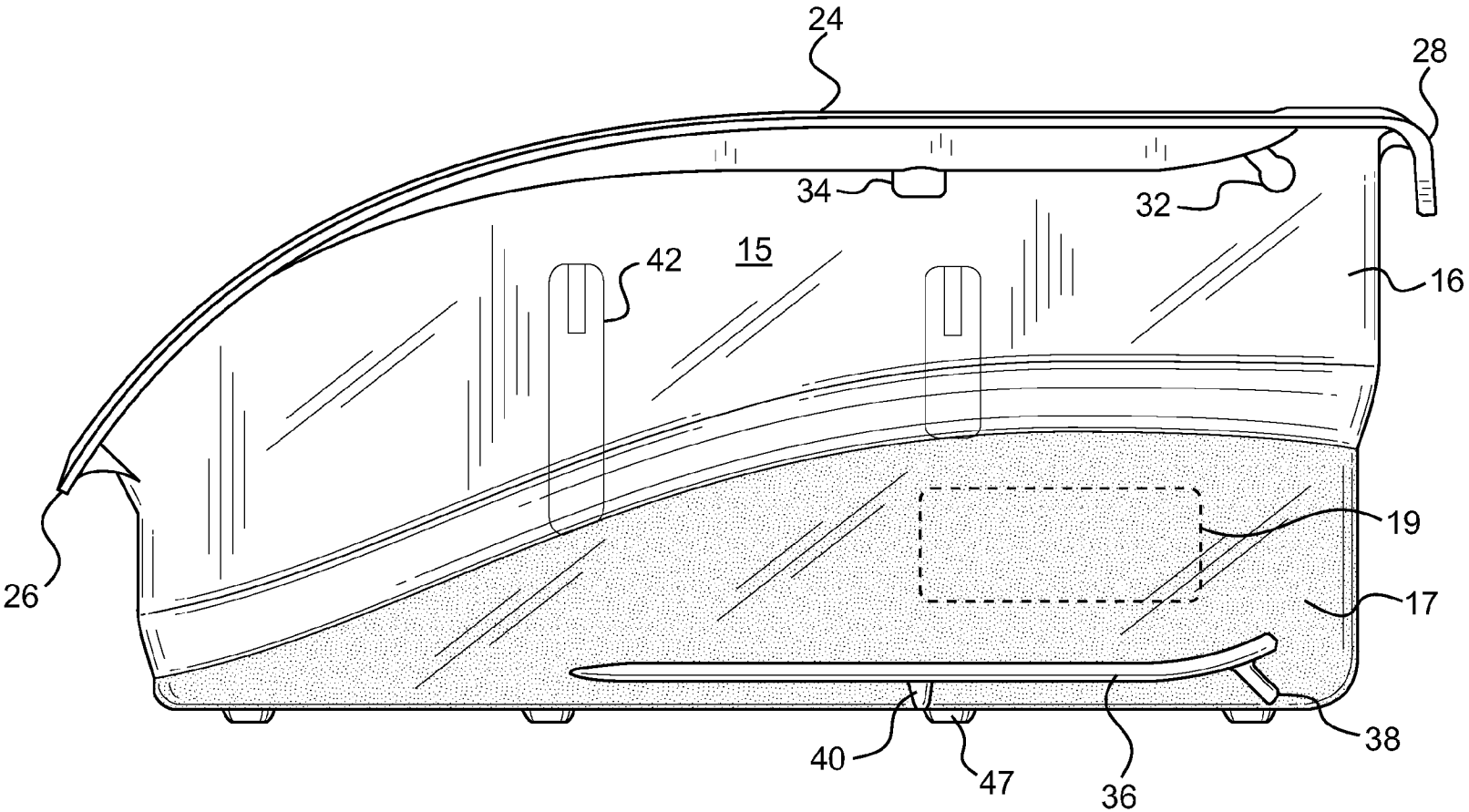
FIG. 4 is a right side elevational view thereof.
Figure 5:
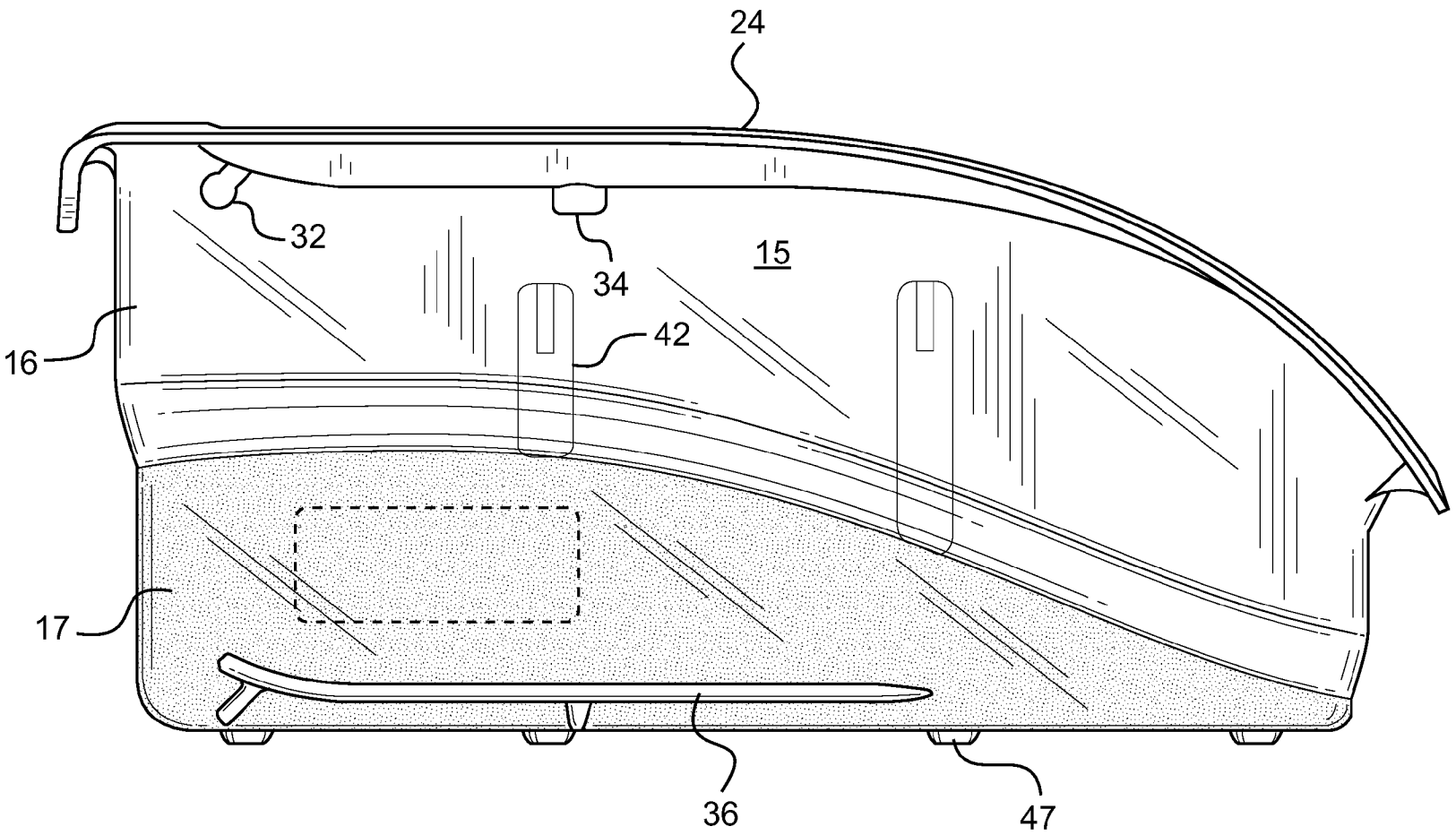
FIG. 5 is a left side elevational view thereof.

The front end wall 18 has a height lower than a height of the side walls to form a bin opening 20 for placing or removing an article into or from the bin. The side walls 15 are higher on the back and extend straight in a horizontal plane for approximately half their length and then are curved downwardly until they meet the top of the front end wall having a lower height. The upper portion of each side wall 15 preferably is transparent with the transparent portion slanting downwardly as it extends to the lower front end, where substantially all of the side wall is transparent. The bottom portion 17 of each side wall is preferably translucent and the translucent portion slants downwardly at approximately the same angle as the transparent portion 16 of the side wall until it reaches the bottom of the front end wall 18. As shown in FIGS. 1 and 4, the bottom portion 17 of one side wall may be provided with an area 19 for a product logo which may be either molded into the area or a logo label applied to the area.

A rim 24 is provided around an open top of the body of the bin and overhangs each of the side walls, the front end wall and the rear end wall. The rim is provided with a downwardly extending back lip 28 adjacent the top of the rear end wall whereby the lip may be attached to a supporting structure such as a louvered panel or a louvered wall. The rim also includes a front lip 26 which overhangs and extends downwardly at an angle to provide a gripping surface whereby the front of the bin may be gripped by engaging the front lip.

The rim 24 further is provided with a recessed ledge 30 on the inside adjacent the top of the side walls. A first slot 32 is provided in an upper edge of each side wall adjacent a rear end thereof and opens into the rim. The first slot is angled forwardly at an angle which preferably is approximately forty five degrees. A vertical second slot 34 is formed in the upper edge of each side wall at a position spaced forwardly from the first slot and also opens into the rim.

A horizontal rib 36 is provided adjacent the bottom of each side wall and extends outwardly therefrom with the rib extending from a position adjacent the rear end wall to a position beyond the mid point of the side wall. The rib preferably has a flat top surface and a flat bottom surface and the rear end of the rib extends upwardly as indicated by the numeral 37.

Figure 12:
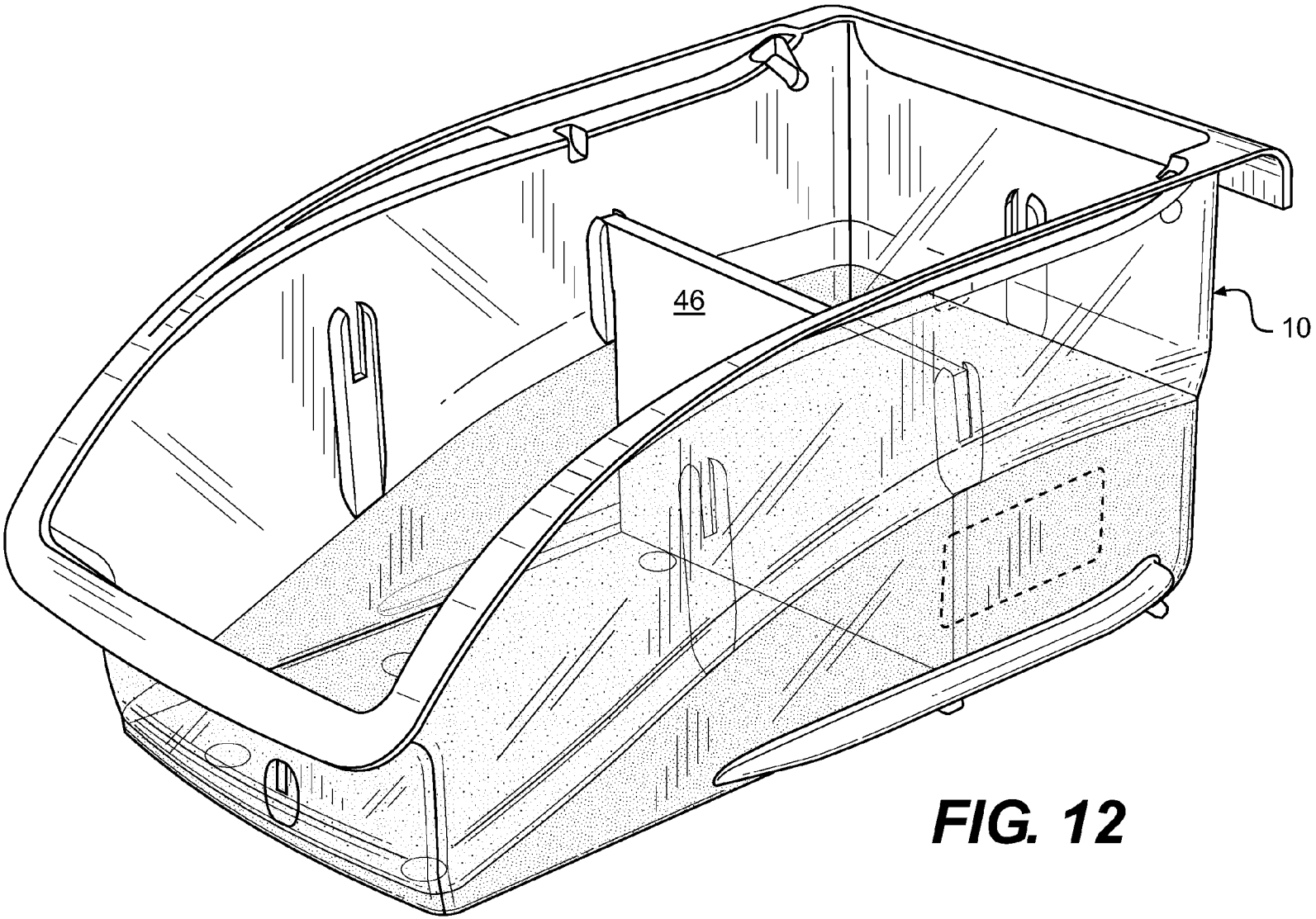
FIG. 12 is a right side perspective view of the storage bin of FIG. 1 illustrating a widthwise divider wall in a mid portion thereof.

A first tab 38 angled forwardly at approximately the same forty five degree angle as the first slot 32 extends downwardly from the rear end of the rib 36 at a position below the upturned end 37 of the rib to form a notch 38 therebetween. A vertical second tab 40 extends downwardly from a mid portion of the rib 36 whereby it is spaced forwardly from the angled first tab 38. The angled first tab 38 is positioned on the rib so that it is vertically aligned with the angled first slot 32 and the vertical second tab 40 is positioned on the rib so that it is vertically aligned with the vertical second slot 34. The insides of the side walls are provided with one or more pairs of opposed notches 42 formed in a notch body which protrudes outwardly from the inside of the wall and which terminates on its bottom side at the intersection between the transparent upper portion 16 of the side wall and a translucent portion 17 of the side wall. As shown in FIG. 12, a widthwise divider wall 46 may be mounted in a pair of the opposed notches 42 in the side walls whereby the upper ends of the divider wall are interlocked with the notches 42. The body of the storage bin narrows at the intersection where the top portion 16 of each side wall meets the bottom portion 7 of each side wall. Accordingly, the divider wall 16 is narrower at its bottom portion below the upper ends so that it fits snugly between the side walls at the lower portions thereof. Notches 44 also are provided on the inside of the front and rear end walls to accommodate a lengthwise divider wall (not shown).

The bottom wall 14 of the storage bin is provided on its lower side with a plurality of feet 47 which are spaced in two rows on each side of the lower surface of the bottom. The feet support the storage bin on a surface so that the bottom wall does not rest right on a surface.

Figure 6:
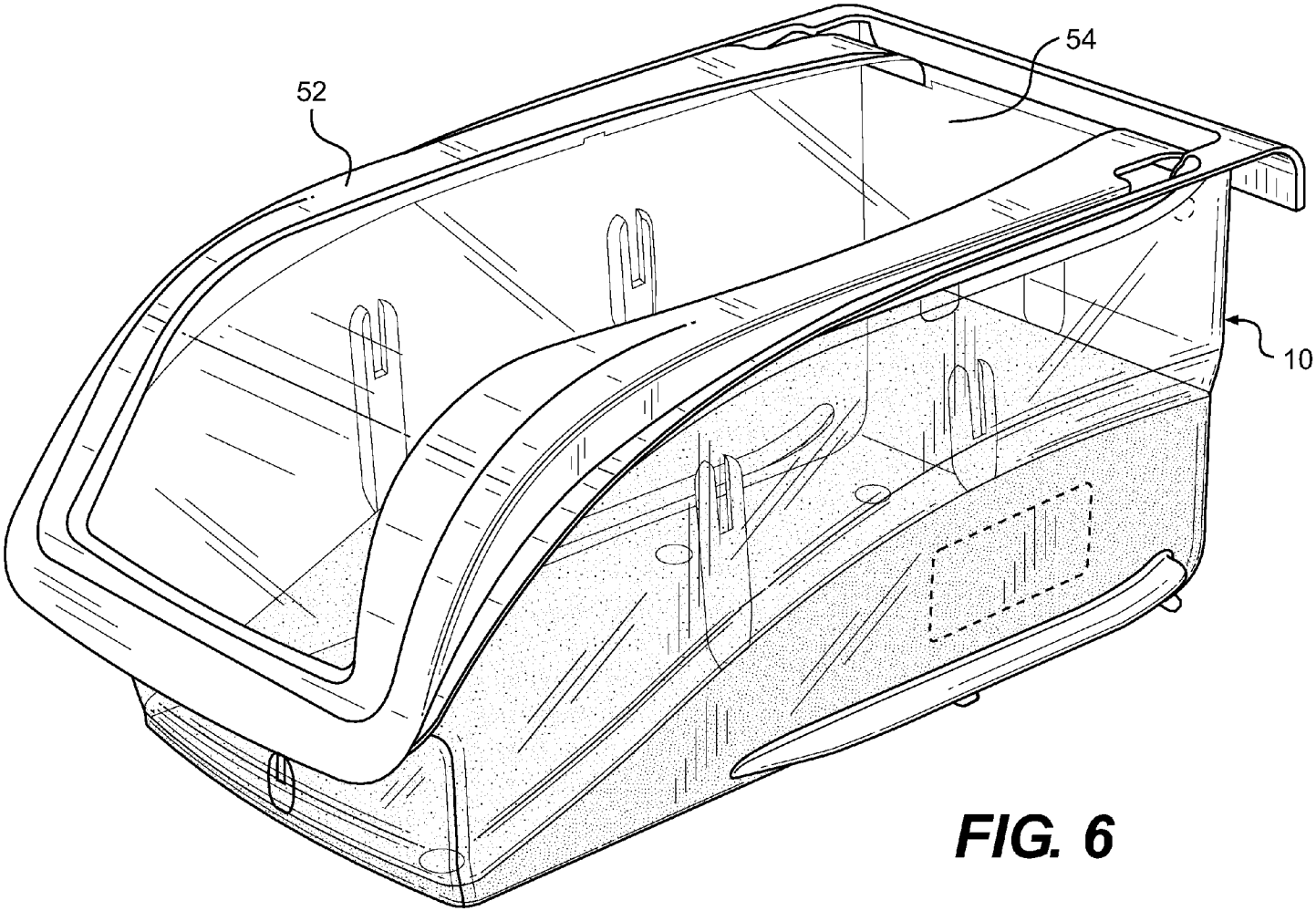
FIG. 6 is a right side perspective view of the storage bin of FIG. 1 illustrating a lid thereon.
Figure 7:
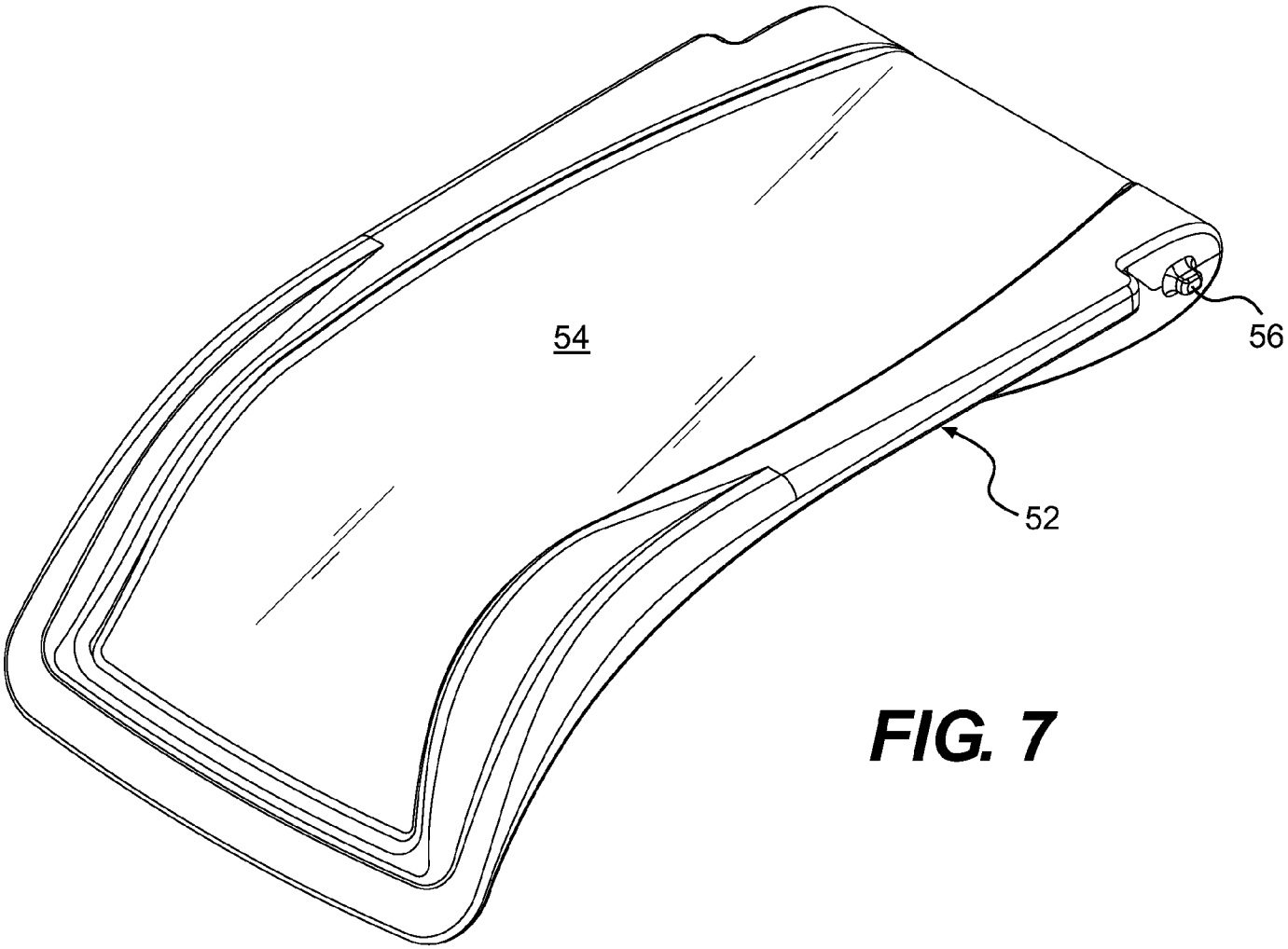
FIG. 7 is a right side perspective view of the lid of FIG. 6.
Figure 11:
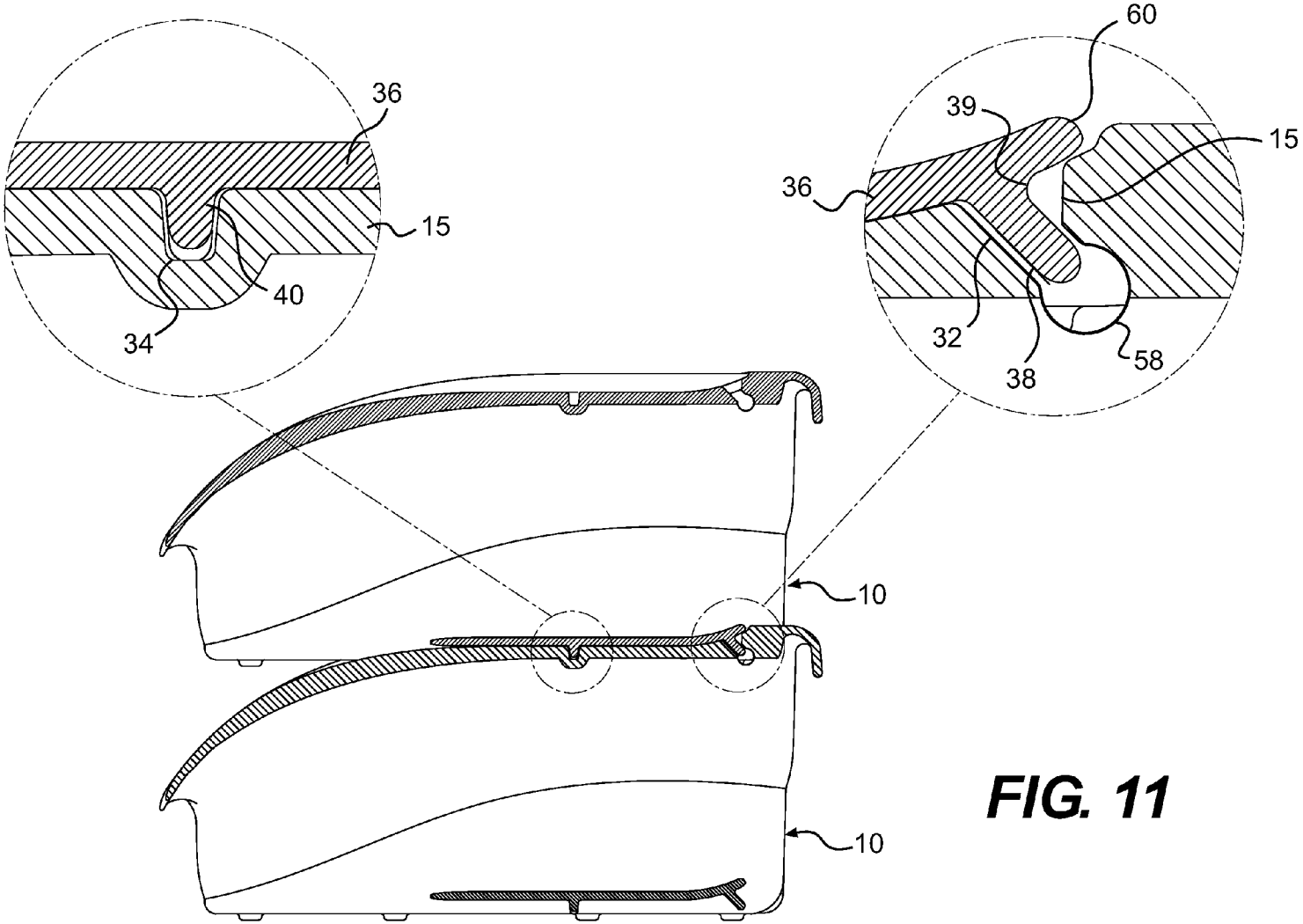
FIG. 11 is a right side elevational view, partially in section, showing two storage bins in complete interlocked relation and having enlarged circle portions showing the manner in which tabs of an upper bin interlock with slots in a lower bin.

As shown in FIGS. 6 and 7, the storage bin also may be provided with a removable lid 54 which is pivotably connected to the rear portion of the body by a pair of pivot pins 56 which extend outwardly at the side from each end of the lid and which engage the angled slots 32 in the upper edge of the side wall. The pivot pins preferably are rectangular shaped at their outer ends. As shown in FIGS. 4 and 11, the angled slot 32 has an enlarged circular portion 58 at the bottom thereof in which a pivot pin is received so that the pivot pin 56 is retained in the slot 32 when the lid is initially rotated but wherein the pivot pin may be easily removed by rotating the pivot pin to an angle whereby the rectangular end of pivot pin 56 may slide out through the main portion of the slot 32.

Figure 8:
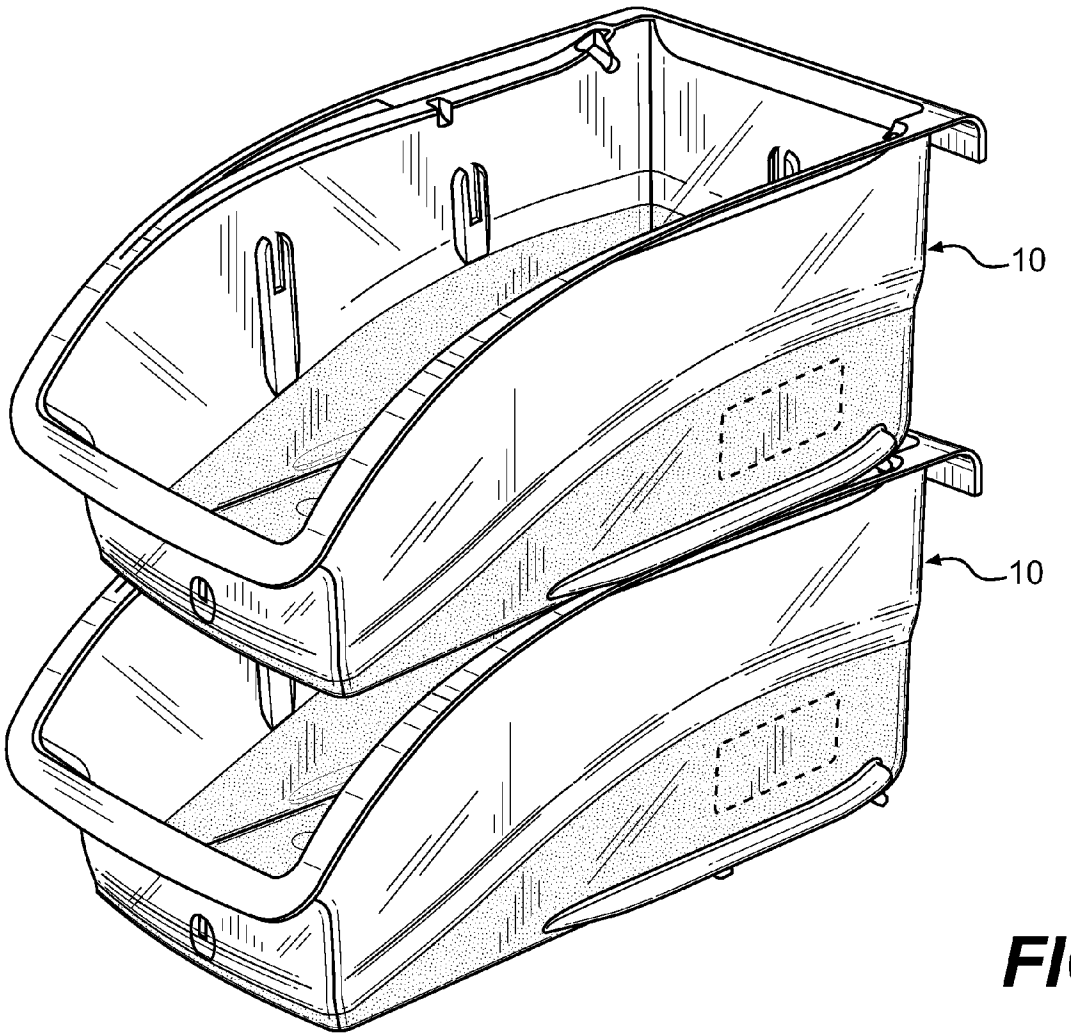
FIG. 8 is a right side perspective view of two storage bins of FIG. 1 interlocked in a vertically stacked array.
Figure 9:
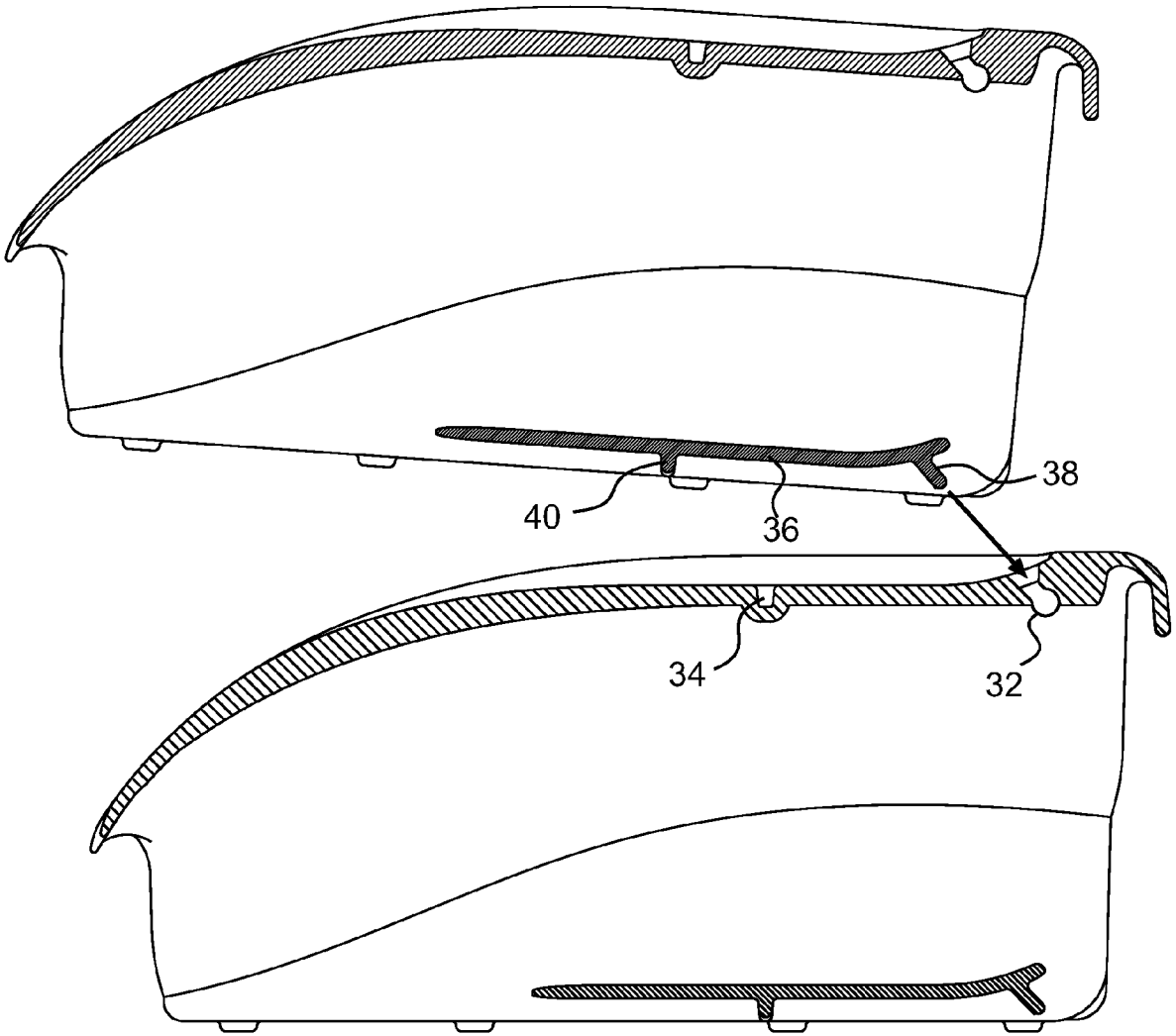
FIG. 9 is a right side elevational view, partially in section, showing an upper bin in the process of being inserted into interlocking engagement with a lower bin.
Figure 10:
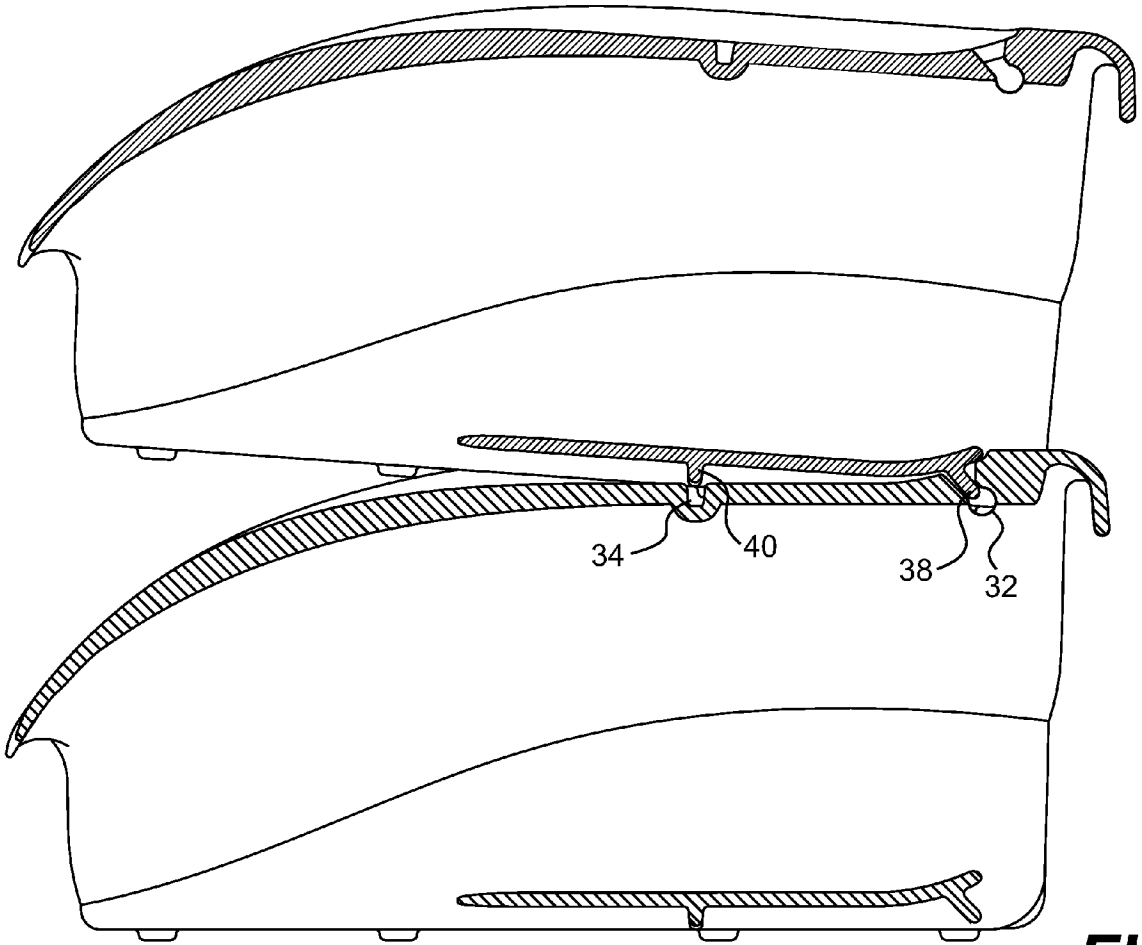
FIG. 10 is a right side elevational view, partially in section, showing two of the storage bins in partially interlocked stacked relation.

The construction of the storage bin permits two of the bins to be stacked on top of each other in interlocked relation as shown in FIG. 8 when the lids are removed from the open top of the storage bin. The sequence of stacking two bins is shown in FIGS. 9-11. As shown in FIG. 9 an upper bin initially is positioned above the top of the lower bin and then the upper bin is angularly lowered in the direction of the arrow in FIG. 9 until the first angled tab 38 of the upper bin is inserted at approximately a forty five degree angle into the angled first slot 32 of the lower bin as shown in FIG. 10 and the vertical second tab 40 of the upper bin is inserted into the vertical second slot 34 of the lower bin until the upper bin is interlocked with the lower bin by virtue of the tabs and slots as shown in FIG. 11.

In the enlarged circular drawing in the upper right hand side of FIG. 11, the angled tab 38 is shown inserted into the slot 32. As further shown in this enlargement, a protruding bump 60 is formed in wall 15 whereby the bump 60 fits in the notch 39 formed between the upturned end 37 of the rib 36 and the angled first tab 38 to further enhance the interlocking of an upper bin and a lower bin. This construction also prevents the upper bin from tipping or tilting upwardly since the bump is locked into the notch 39. The tip of upturned end 37 abuts the portion of the side wall 15 above the bump 60. In addition, as shown in the enlarged circular drawing on the upper left side of FIG. 11, the vertical tab 40 is received in the vertical slot 34 to prevent any forward movement or sliding of the upper bin with respect to the bottom bin.

With the interlocking construction as just described, the mating of the angled tab 38 with the angled slot 32 prevents the upper bin from tilting upwardly at the back end while the vertical second tab 40 in the vertical slot 34 prevents longitudinal sliding movement of the top bin with respect to the bottom bin. To disengage the two bins, the upper bin is lifted from the front end and tilted upwardly whereby the tabs are disengaged from the slots.

Two bins also may be stacked one atop another in a vertical array even though a lid is on the lower bin. Although not shown in the drawings, when the lower bin has a cover thereon, an upper bin may be placed thereon and at least some of the feet 47 on the bottom of the upper bin fit within the recessed center portion 54 of the lid 52 to maintain the two bins in a stacked relation.

The invention claimed is:

1. A stackable storage bin comprising:

a bottom wall, two spaced opposed side walls, a rear end wall and a front end wall integrally connected to form a body having an open top;

a rim extending around said open top;

a first slot angled forwardly and formed in an upper edge of said wall adjacent a rear end thereof and opening into said rim, said slot having upper and lower walls, both of which are angled forwardly;

a vertical second slot formed in the upper edge of each side wall at a position spaced forwardly from said first slot and opening into said rim;

a first tab angled forwardly at approximately the same angle as said first slot and formed adjacent a bottom edge of each side wall at a position vertically aligned with said first slot; and a vertical second tab formed adjacent a bottom edge of each side wall at a position vertically aligned with said vertical second slot;

whereby when two of the bins are in a vertically stacked array, said angled first tabs and said vertical second tabs of an upper bin engage said angled first slots and said vertical second slots of a lower bin to interlock the two bins together; and which further includes a removable lid having a pivot pin projecting outwardly on each side adjacent a rear end thereof for accommodation in the angled slot adjacent the rear end of each side wall when the lid is mounted on the bin.

2. The stackable storage bin according to claim 1 wherein the lid includes a recessed center portion extending longitudinally of the top thereof and the bin includes a plurality of feet on the bottom portion thereof whereby at least some of the feet on the bottom portion of an upper bin are accommodated in the recess of a lid of a lower bin when the upper bin is stacked on a lower bin having a lid mounted thereon.

3. The stackable storage bin according to claim 2 wherein said recessed center portion of the lid is at least partially transparent.

* * * * *